US008704664B1

(12) United States Patent
Brown

(10) Patent No.: US 8,704,664 B1
(45) Date of Patent: Apr. 22, 2014

(54) ANTI-THEFT TAG FOR A PRODUCT HAVING A RIDGED PORTION AND METHOD OF USE

(75) Inventor: David W. Brown, Cumberland, RI (US)

(73) Assignee: Display Technologies, Inc., Johnston, RI (US)

( * ) Notice: Subject to any disclaimer, the term of this patent is extended or adjusted under 35 U.S.C. 154(b) by 266 days.

(21) Appl. No.: 13/245,046

(22) Filed: Sep. 26, 2011

(51) Int. Cl.
*G08B 13/14* (2006.01)

(52) U.S. Cl.
USPC ..... 340/572.1; 340/572.8; 340/568.1; 340/10.1

(58) Field of Classification Search
USPC ..... 340/572.1
See application file for complete search history.

(56) References Cited

U.S. PATENT DOCUMENTS 6,488,531 B1 12/2002 Kolton et al.
7,363,783 B2 4/2008 Kolton et al.
7,412,857 B2 8/2008 Kolton et al.
8,228,200 B2 7/2012 Kolton et al.
8,267,326 B2 * 9/2012 Kolton et al. ..... 235/492
8,432,286 B2 4/2013 Kolton et al.
8,466,793 B2 6/2013 Kolton et al.
2009/0273446 A1 * 11/2009 Andrenko et al. ..... 340/10.1
2010/0253480 A1 * 10/2010 Teeter ..... 340/10.1

* cited by examiner

*Primary Examiner* — Kerri McNally
(74) *Attorney, Agent, or Firm* — Dingman, McInnes & McLane, LLP

(57) ABSTRACT

An anti-theft tag for use with a product having one or more ridges includes a base for supporting an EAS sensor, a body including a product engagement portion having an opening, a locking member, and a detachment section. The locking member engages and secures the tag to a product having a ridged portion during use. The locking member can flex in a first direction as the product is received within the engagement member, and locks into engagement with the product to prevent removal of the tag. Detachment allows removal of the tag by cutting the detachment section and allowing the opening to be expanded and the product removed.

24 Claims, 13 Drawing Sheets

ANTI-THEFT TAG FOR A PRODUCT HAVING A RIDGED PORTION AND METHOD OF USE

TECHNICAL FIELD

This invention relates generally to an anti-theft tag and, more specifically, to an anti-theft tag for use with a product having one or more ridges or grooves, which act as a stop to deter unauthorized removal of the tag.

BACKGROUND

It is well known in the art of theft deterrence to use electronic article surveillance (EAS) sensors in order to discourage the theft of consumer products. In use, EAS sensors trigger an alarm if not detached or disarmed before the product is removed from the store. For many products, electronic sensors have been very effective in deterring theft. Often, the EAS sensors are hidden in a tag that is attached to a product. However, such sensors can be difficult to attach to certain products, for example tools and fixtures, and can often be easily removed from such items even when attached. One item that is difficult to effectively attach an electronic sensor to is plumbing fixtures, for example faucets, which come in a variety of different sizes and configurations. EAS stickers can be too easily removed from such items, and tags that effectively deter theft can be difficult to both attach and remove once the item is purchased. It is also desirable that the UPC code also be affixed to the item for tracking and return purposes.

SUMMARY

The anti-theft tag of the present application is easy to apply to an item having a ridged surface, deters theft by being difficult to remove in-store, and is readily removed by a consumer after the product has been purchased. In addition, the anti-theft tag can be readily made in a variety of sizes to fit the particular product. The anti-theft tag includes a base for supporting an EAS sensor, a body including a product engagement portion having an opening including a locking member, and a detachment section. The locking member engages and secures the anti-theft tag to the ridged portion of the product during use.

In one embodiment, the locking member may include a plurality of flexible fingers disposed around the circumference of the opening. The flexible fingers are designed to flex in a first direction as the product is received within the engagement member, and to lock into engagement with the ridged portion of the product to prevent removal of the anti-theft tag, by limiting movement of the tag in a second direction, opposite the first. The fingers may be tapered and include a channel between each adjacent finger to allow the fingers to flex during application of the tag.

The detachment section, when cut, enables removal of the anti-theft tag. In one embodiment, the detachment section is formed as a tab extending from the product engagement portion with a channel extending from the tag to the interior of the opening in the product engagement portion. In another embodiment, the detachment section is formed as a channel within the product engagement portion itself. In either embodiment, when the tab or channel is cut it allows the circumference of the opening to be expanded and the tag to be removed from engagement with the product.

In order to attach the anti-theft tag to the product, the opening of the product engagement portion is aligned with the ridged or threaded portion of the product. The ridged portion is inserted into the opening, and the tag is moved in a first direction onto the ridged portion such that the flexible fingers engage the ridges or threads. As the fingers engage the one or more ridges, the ridges act as a stop, preventing removal of the tag from the product when the tag is moved in a second direction, opposite the first. In one embodiment, the engagement portion is molded of plastic and the flexible fingers extend from the body of the engagement portion. To remove the tag, the consumer cuts through the plastic at the detachment section to the channel, allowing the circumference of the opening to be expanded and the tag to be removed from engagement with the product.

The anti-theft tag described herein can readily be used with a variety of ridged items, is tamper resistant by being difficult to remove in-store, and is readily removed by a consumer after the item has been purchased without damaging the item. The features of the anti-theft assembly as described herein may be used with any of a variety of items, including ones that have a stop portion, such as a ridge or threaded portion.

BRIEF DESCRIPTION OF THE DRAWINGS

The foregoing and other objects, features and advantages will be apparent from the following description of particular embodiments, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF THE ILLUSTRATIVE EMBODIMENTS

Figure 1:
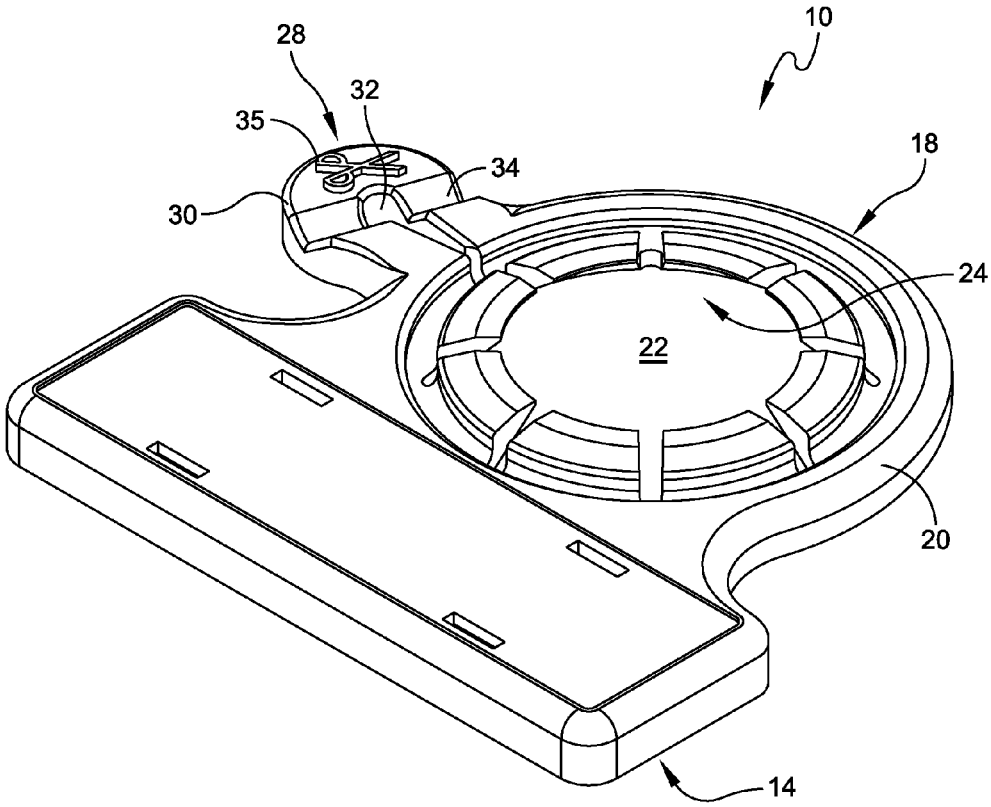
FIG. 1 is a top perspective view of a first embodiment of an anti-theft tag for use with a product having a ridged portion according to the present disclosure.
Figure 2:
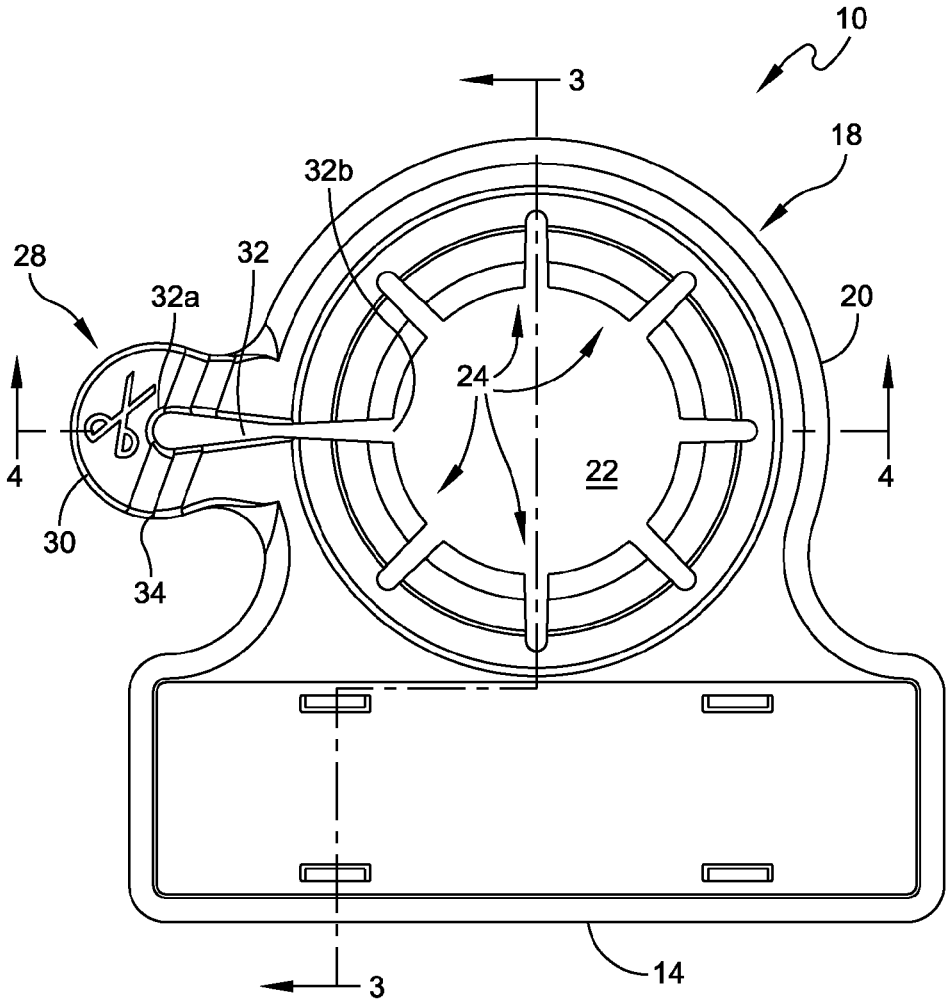
FIG. 2 is top, plan view of the anti-theft tag of FIG. 1.
Figure 3:
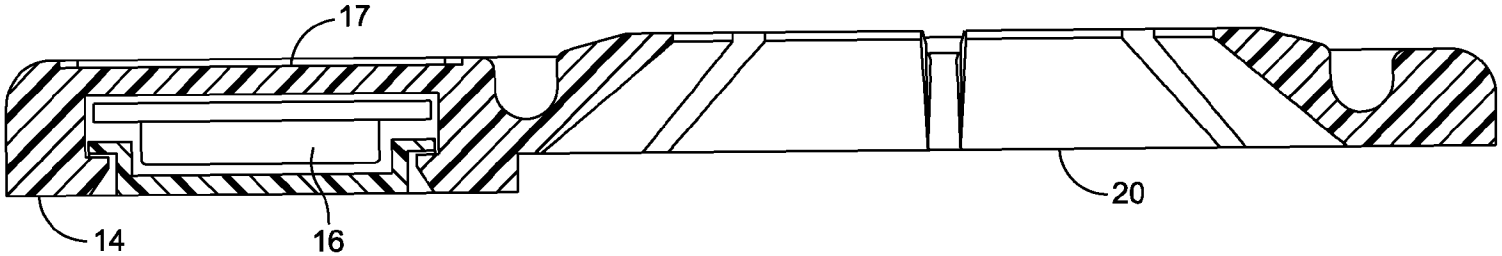
FIG. 3 is a cross-section view of the anti-theft tag taken along lines 3-3 of FIG. 2.
Figure 4:
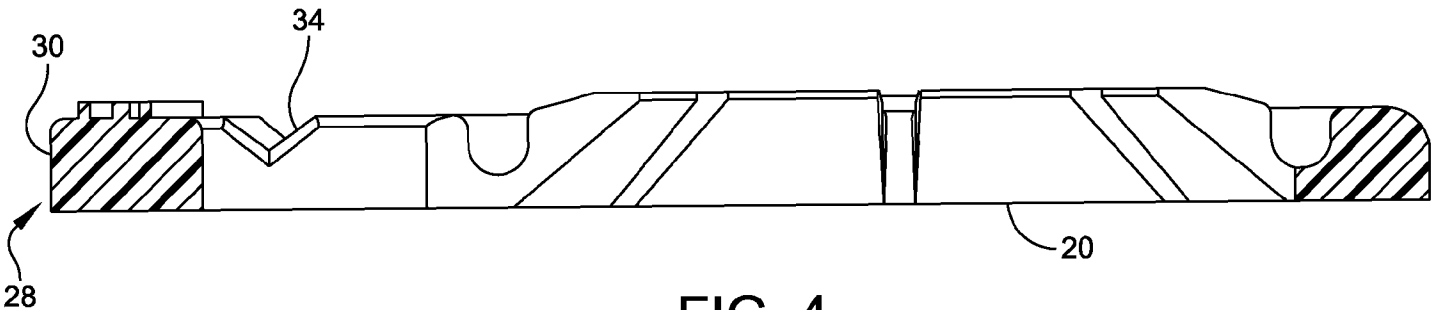
FIG. 4 is a cross-section view of the anti-theft tag taken along lines 4-4 of FIG. 2.
Figure 5:
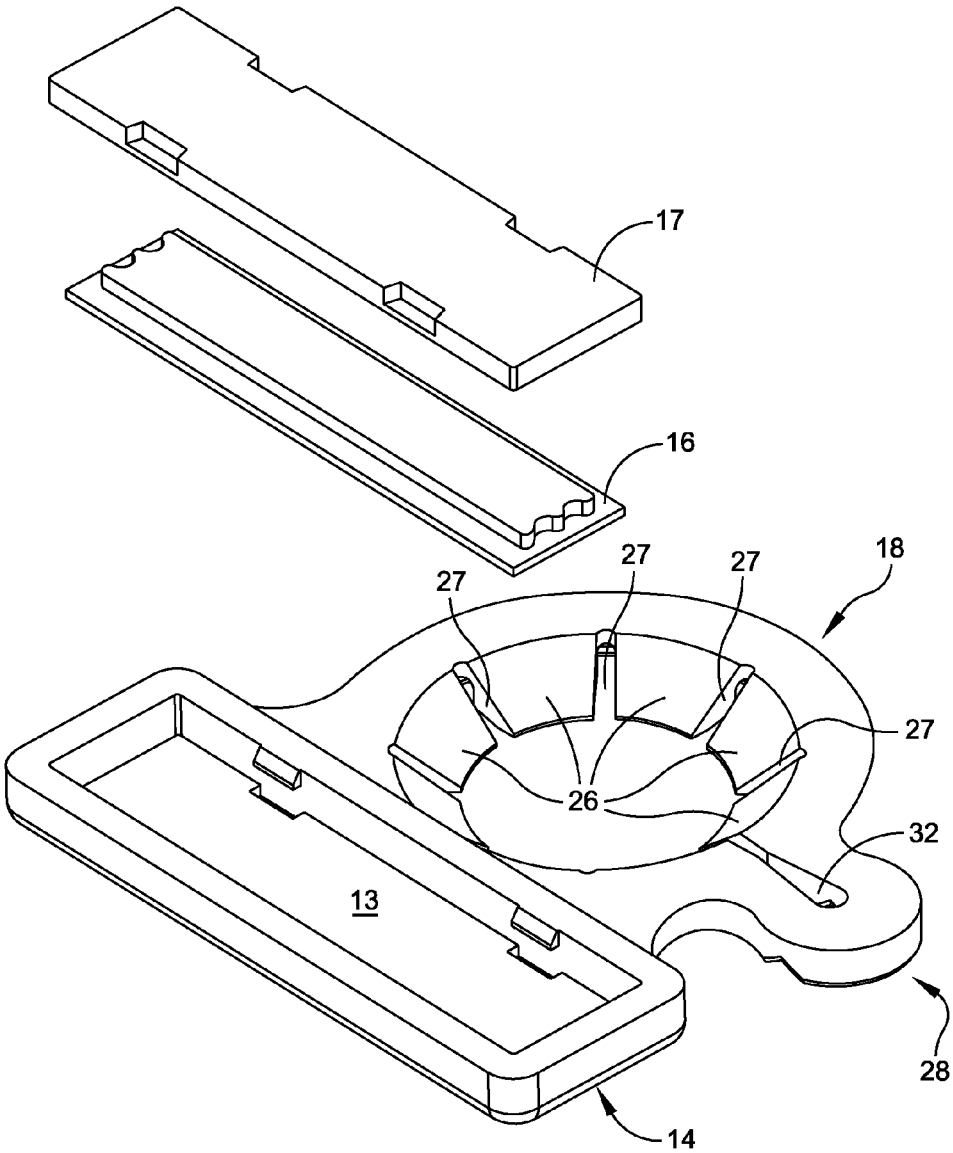
FIG. 5 is an exploded view of the anti-theft tag of FIG. 1.

The embodiments disclosed herein relate to an anti-theft tag for use with a product having a ridged portion. As used herein, the term "ridge" refers to any item having a raised portion, such as a flange or a stop which may take the form of one or more ridges, including but not limited to a threaded portion, for example a threaded shaft or cylindrical member. As also used herein, the term "electronic article surveillance" (EAS) tag, sensor, label or marker refers to any conventionally available article surveillance sensor that triggers an alarm if not detached, deactivated or disarmed before the product is removed from a designated area, such as a store, as is known in the art. Although referred to as "electronic", EAS sensors include, but are not limited to, conventional EAS sensors such as acousto-magnetic (A/M) sensors, magnetic sensors, radio-frequency (RF) sensors, and the like, as would be known to those of skill in the art past, present or developed in the future.

Referring initially to FIGS. 1-8, an exemplary first embodiment of an anti-theft tag 10 used to deter theft of a product 11, for example a pipe, having a ridged portion 12 is illustrated. The anti-theft tag 10 includes a base 14 that can be used to support an EAS sensor 16 and a body 18, which includes a product engagement portion 20 having an opening 22, a locking member 24, and a detachment section 28. The locking member 24 engages and secures the anti-theft tag 10 to the ridged portion 12 of the product 11 during use, as described in greater detail below.

Base 14 preferably includes a cavity 13 for supporting EAS sensor 16, and may also include a cover 17 to conceal the EAS sensor 16 and provide a surface for attaching a product label, UPC code, or the like. In the present embodiment, the base 14, cavity 13, and cover 17, all have a generally rectangular shape in order to support the rectangular EAS sensor 16. Alternatively, other shapes may be employed, depending upon the shape of the EAS sensor being supported by the base. In addition, although cavity 13 and cover 17 are provided in the present embodiment, it may be desirable in some circumstances to eliminate the cavity and/or cover. If a cavity is provided, the EAS sensor can be supported within the cavity 13, and if a cover is provided, the cover 17 may thereafter be applied over the cavity, as illustrated. A label or UPC code may thereafter be placed on the cover 17, if desired.

Body 18 extends from base 14, and includes product engagement portion 20 in which opening 22 is disposed. The base 14 and the product engagement portion 20 may be formed as separate components, or may be formed as a single, unitary member. Opening 22 has a shape and size chosen according to the shape and size of the product 11 to be protected. In the present embodiment, the opening 22 is illustrated as having a generally circular shape, as many of the products to be protected from theft include a cylindrical structure. The opening is also sized according the size of the product to which the anti-theft tag is to be applied. Accordingly, the diameter of opening 22 may be larger or smaller than illustrated, depending upon the corresponding diameter of the product to be protected. Additionally, other shapes may be utilized for opening 22 depending upon the shape of the ridged portion of the product. Extending into opening 22 is locking member 24, which engages the ridged portion 12 of the product during use to prevent removal of the anti-theft tag 10.

Figure 6:
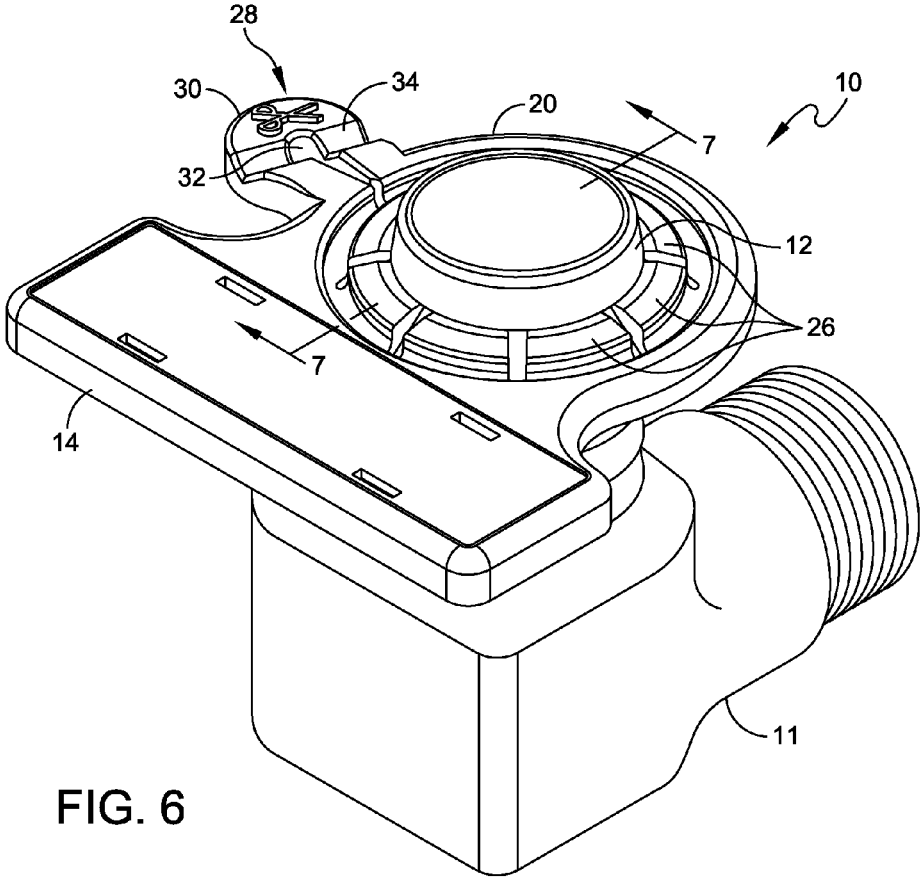
FIG. 6 is a perspective view of the anti-theft tag of FIG. 1 being attached to an exemplary product having a ridged portion in a first position.
Figure 7:
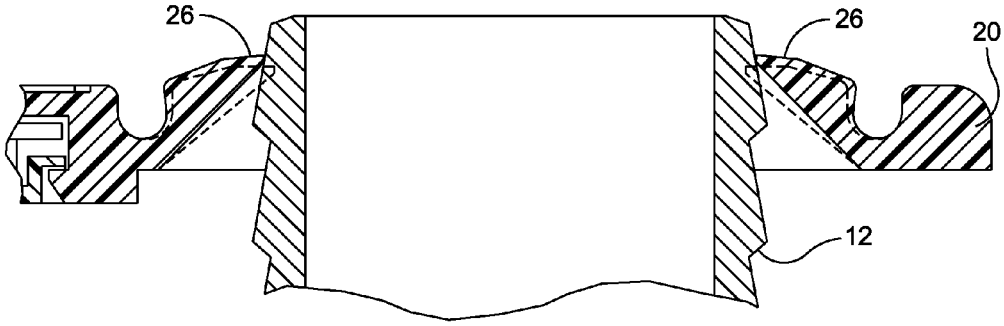
FIG. 7 is a cross-sectional view of the anti-theft tag taken along lines 7-7 of FIG. 6.
Figure 8:
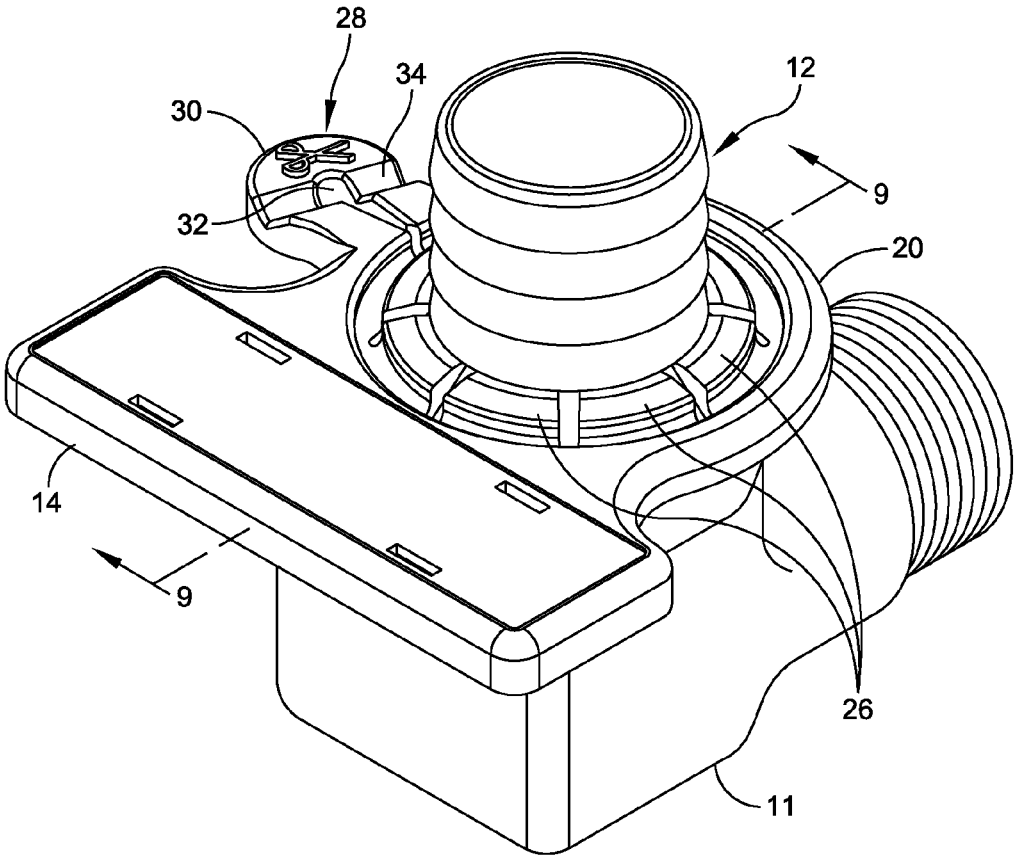
FIG. 8 is a perspective view of the anti-theft tag of FIG. 1 being attached to the exemplary product having a ridged portion in a second position.

Referring now to FIGS. 6-9, locking member 24 may preferably include a plurality of fingers 26 or projections disposed about the perimeter of the opening 22 and extending into the opening 22 in the present embodiment. Although the locking member 24 as illustrated includes a plurality of fingers 26 that circumscribe opening 22, the locking member need not circumscribe the entire opening 22, and may instead be positioned selectively about the opening. The fingers 26 are designed to flex in a first direction as one or more ridges of the ridged portion 12 are received within the opening 22 of the engagement portion 20 (FIGS. 6 and 7). In the present embodiment, the fingers 26 are tapered and include a channel 27 between each adjacent finger 26 to allow the fingers to flex during application of the tag, as shown in FIG. 7. Alternatively other configurations, which allow the fingers to flex, may also be utilized. In the present embodiment the exemplary product 11 is a portion of a pipe, which may be made from metal or other material, and the ridged portion 12 is a threaded portion on the pipe. Other alternate product configurations may also be utilized, as would be know to those of skill in the art, the product illustrated being exemplary in nature only.

Figure 9:
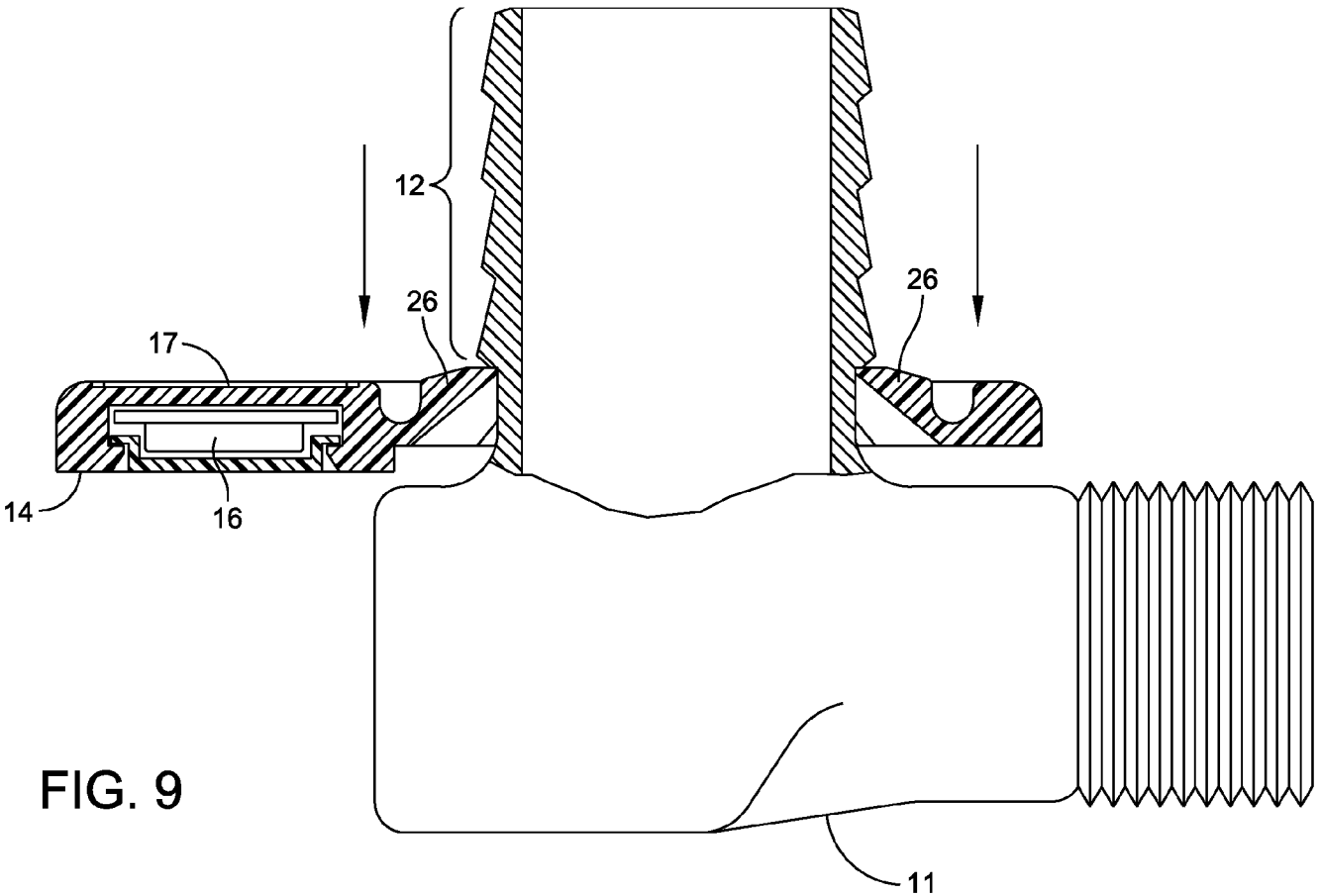
FIG. 9 is a cross-sectional view of the anti-theft tag taken along lines 9-9 of FIG. 8.

After the locking member 24 is secured onto the ridged portion of the product, the locking member 24 and ridged portion 12 together prevent removal of the anti-theft tag from the product. Thus, the flexible fingers 26 can be moved in the first direction, over one or more of the ridges of the ridged portion 12 as shown in FIG. 9, but when moved in a second direction, opposite the first, the fingers 26 engage the ridged portion 12, and the ridged portion 12 acts as a stop. The stop prevents the tag from being moved in a second direction, so that the anti-theft tag 10 cannot be removed from the product. In this manner, the anti-theft tag 10 is readily applied to the product 11, in a fast and convenient manner, but cannot be removed by the consumer without breaking, or preferably cutting the tag 10.

To remove anti-theft tag 10 after purchase, detachment section 28 may be provided that, when cut, enables removal of the anti-theft tag 10 from the product. In the present embodiment, the detachment section 28 is formed as a tab 30 (FIGS. 1-2) that is supported by body 18. The tab 30 includes a channel 32 that extends from the tab to opening 22 in the product engagement portion 20. A first end 32*a* of the channel is constrained by the detachment section 28, while a second end 32*b* extends into opening 22. The tab 30 also includes an indentation or groove 34 to receive a cutting tool, such as a conventional pair of scissors. The thickness of groove 34 is preferably less than the body 18 of the anti-theft tag, and also less than the tab 30. The reduced-thickness allows an average consumer to cut through the tab with a pair of conventional scissors. A symbol 35, such as a pair of scissors, or written instructions 137 (FIG. 13) may be provided to indicated to the consumer where to cut the tag.

Figure 10:
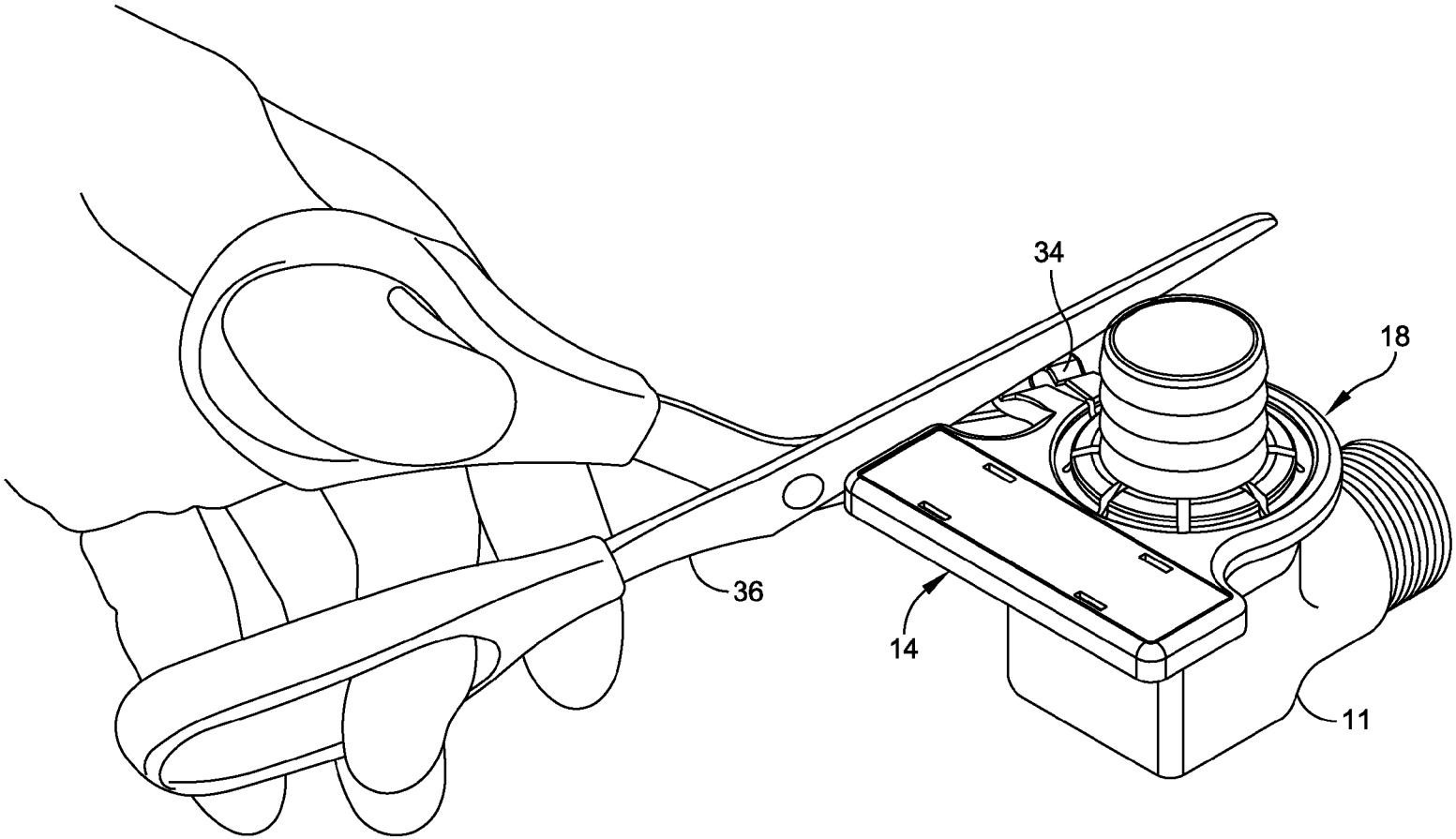
FIG. 10 is a perspective view of the anti-theft tag of FIG. 1 being removed from the product.
Figure 11:
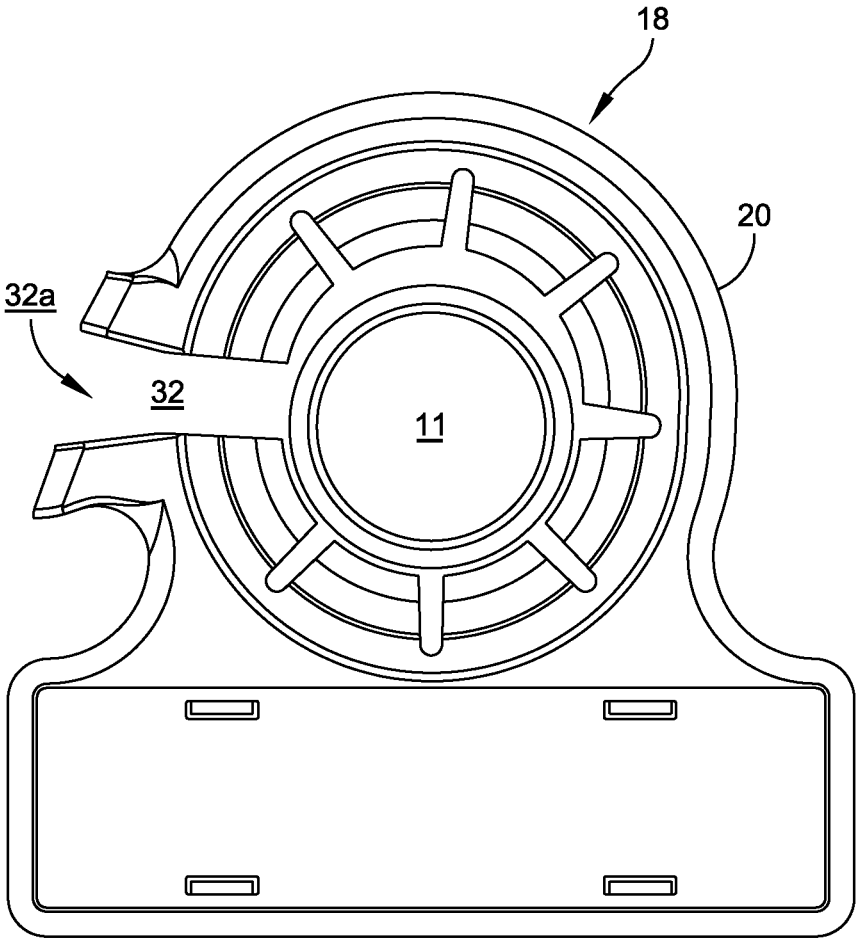
FIG. 11 is a top, plan view of the anti-theft tag of FIG. 10 during removal in a first position.
Figure 12:
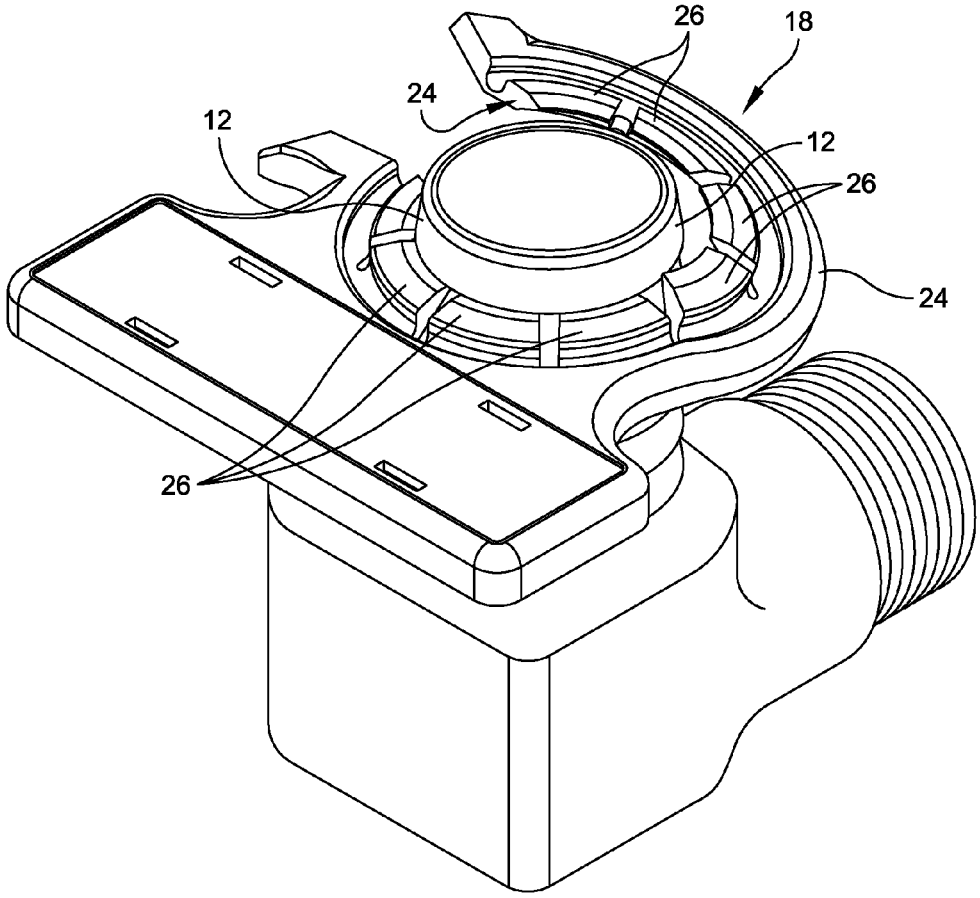
FIG. 12 is a perspective view of the anti-theft tag of FIG. 10 being removed from the product in a second position.

Referring now to FIGS. 10-12 the steps for removing the anti-theft tag 10 from product 11 are illustrated. The first step in removing the anti-theft tag 10 is to cut through the groove 34 using a cutting instrument, for example a conventional pair of scissors 36, as shown. The scissors 36 are aligned with the groove 34 and sufficient pressure is applied to cut through the groove. Once the groove 34 has been cut, the channel 32 is no longer constrained at the first end 32*a* and forms path into body 18 (FIG. 11). The engagement portion 20 can now be removed from the product 11 by twisting or pulling the body 18 of the tag, which effectively allows the circumference of the opening to be expanded, as shown in FIG. 12. By cutting through the engagement portion, the fingers 26 can be easily removed from engagement with the ridged portion 12. In this manner, a consumer can easily remove the anti-theft tag 10 after the product 11 is purchased. However, the tag 10 remains difficult to remove while in a store without calling attention to the theft (for example by using scissors in-store to cut through the detachment section which may be noticed by store employees).

Figure 13:
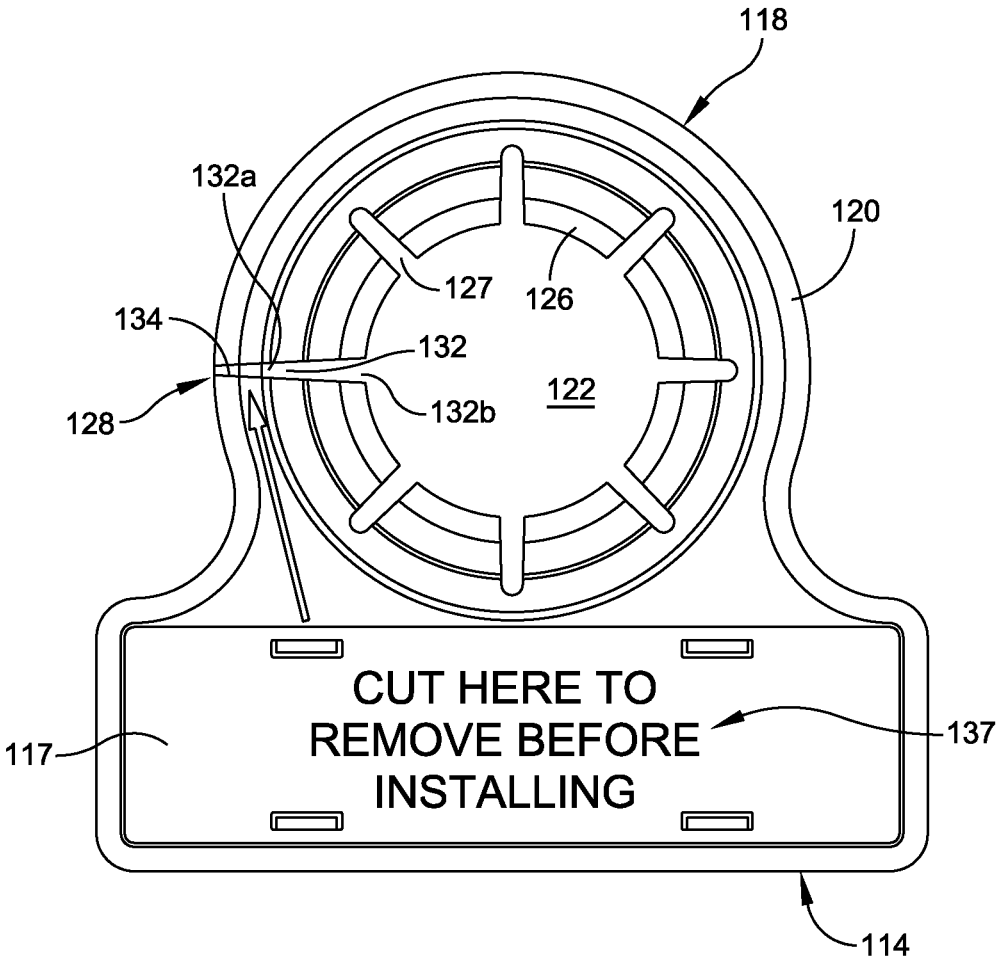
FIG. 13 is a top plan view of a second embodiment of an anti-theft tag for use with a product having a ridged portion according to the present disclosure

In another exemplary embodiment, the detachment section is formed within the product engagement portion, as illustrated in FIG. 13. In this embodiment, the same or similar elements as the embodiment of FIGS. 1-12 are labeled with the same reference numbers, preceded with the numeral "1". As illustrated, detachment section 128 includes channel 132 that extends from opening 122 into the body 118 of the tag 110. The channel 132 is essentially an opening extending into the body, but as the channel moves toward the exterior of the body 118, it turns into groove 134 with a reduced-thickness of material and is no longer a through-opening. The first end 132*a* of the channel is constrained by the detachment section 128, where the groove 134 is formed, while a second end 132*b* extends into opening 122. Thus, the channel 132 and groove 134 are operatively connected within the body 118. The channel 132 and groove 134 may taper along their respective lengths when moving from the opening 122 toward the exterior of body 118, as illustrated in FIG. 13. The reduced-thickness groove 134 allows the tag to be inserted onto the product without breaking, but can be cut through by a consumer with conventional scissors, as described herein above with respect to the first exemplary embodiment. Written instructions 137 that indicate where to cut may be provided on the base 114, or a symbol may be provided, as described above. In both the first and the second embodiments, when the groove is cut it allows the circumference of the opening to be expanded and the tag to be removed from engagement with the product, as also described herein above.

Figure 14:
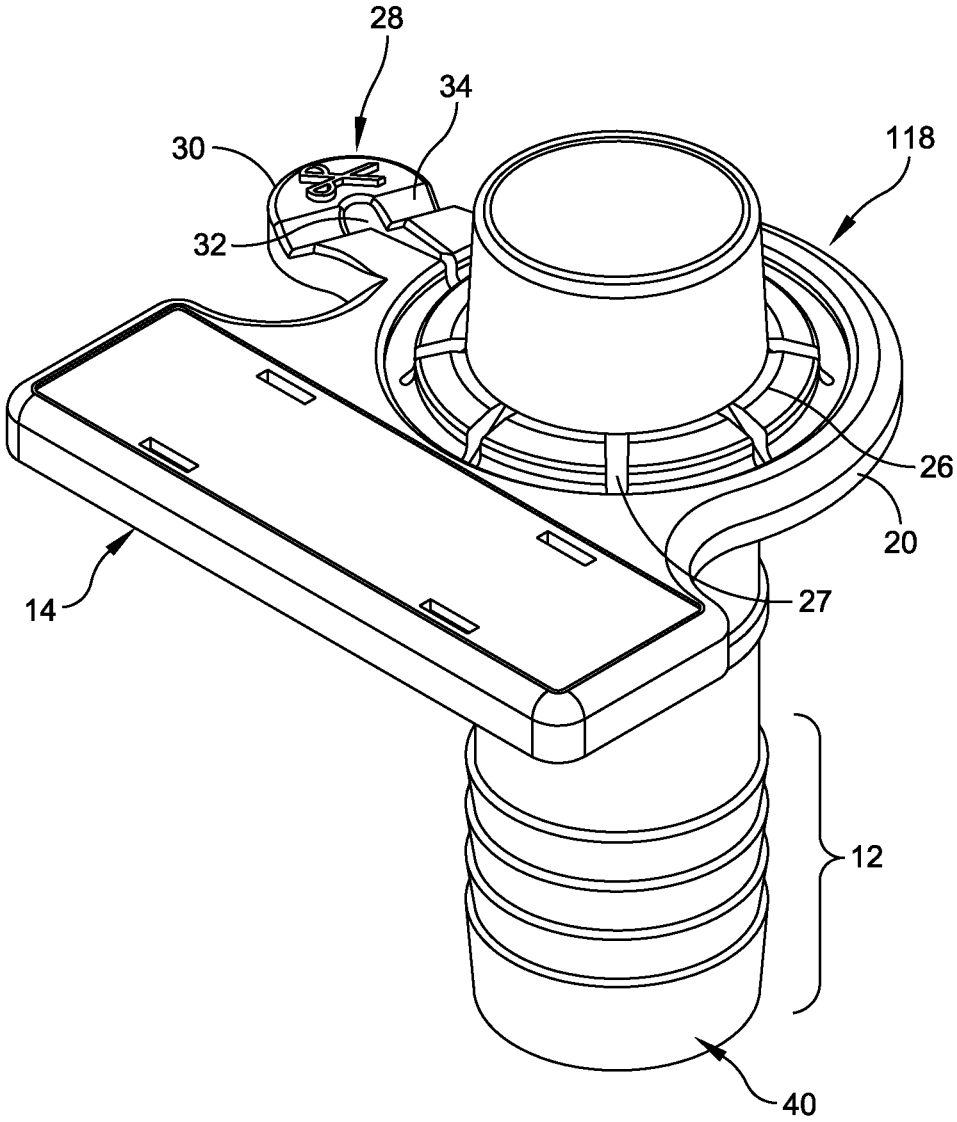
FIG. 14 is a perspective view of the anti-theft tag of FIG. 1 used with another exemplary product having a ridged portion according to the present disclosure.
Figure 15:
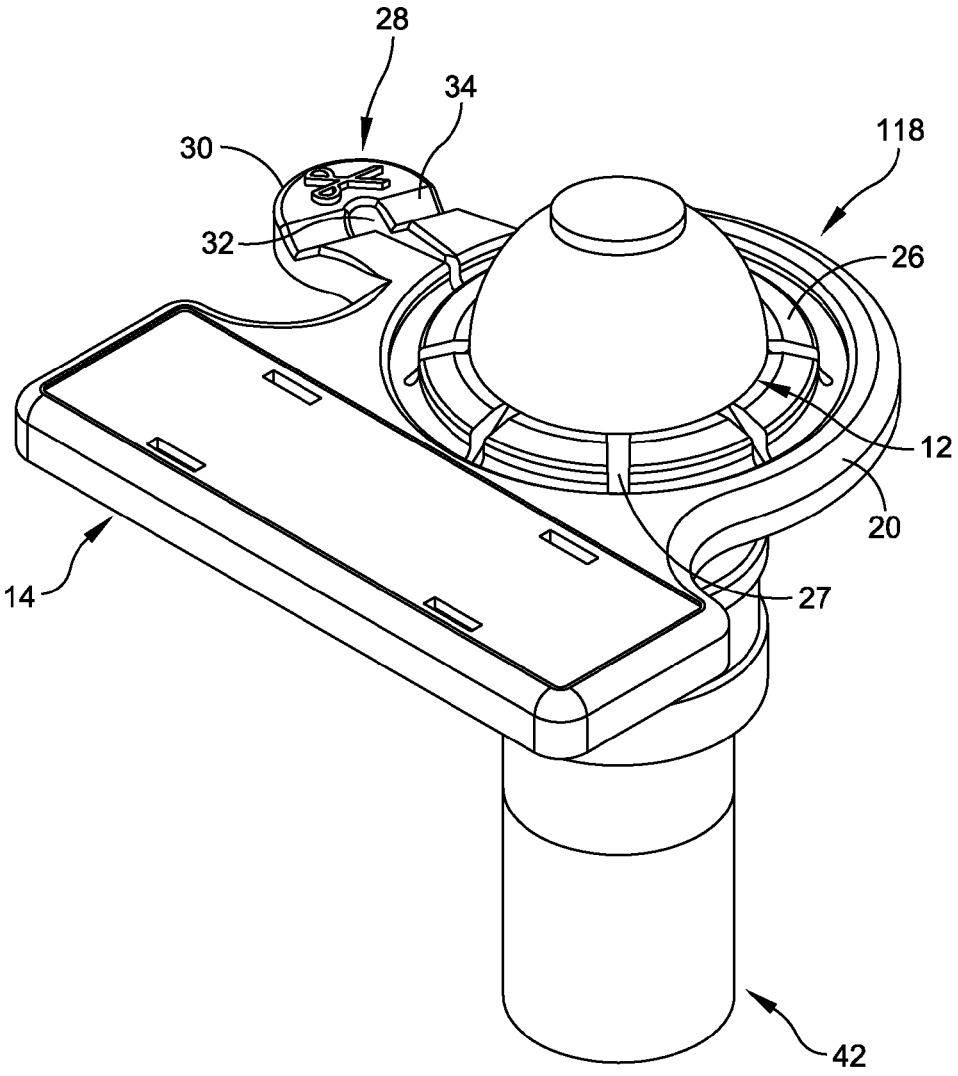
FIG. 15 is a perspective view of the anti-theft tag of FIG. 1 used with another exemplary product having a ridged portion according to the present disclosure.

Referring now to FIGS. 14-15, the anti-theft tag of FIGS. 1-12 is illustrated as used with other exemplary products. FIG. 14 illustrates one such ridged product, 40 formed from plastic and having a ridged portion 12, which is raised and not threaded. Likewise, FIG. 15 also illustrates a ridged product, 42 formed from plastic and having a ridged portion 12, which is not threaded. As described above, the present disclosure is not limited to a particular product, provided that a raised, stop member is provided on the product.

It will be understood by those skilled in the art that various changes in form and details may be made herein without departing from the spirit and scope of the invention as defined by the appended claims. For example, the materials disclosed herein may be readily changed, as may the dimensions and geometric configurations. Also, the method of severing the tag may be different than the exemplary method described herein. Likewise, the flexible fingers member may also be modified. The exemplary products may also vary widely including, but not limited to those illustrated herein. For example, the ridged portion, while being illustrated as continuous and having multiple ridges may be non-continuous and comprise only a single ridge in some embodiments. Therefore, the above description should not be construed as limiting, but merely as exemplifications of preferred embodiments. Those skilled in the art will envision other modifications within the scope, spirit and intent of the invention.

What is claimed is:

1. An anti-theft tag for use with a product having one or more ridges, the tag comprising:

a base constructed and arranged to support an electronic article surveillance sensor;

a body including a product engagement portion having an opening configured and sized to receive a portion of the product therein;

a locking member including a flexible portion constructed and arranged to move over the one or more ridges in a first direction and to engage the one or more ridges in a second direction, opposite the first direction, to deter removal of the tag from the product; and a detachment section including a channel having a first end constrained by the detachment section and a second end that extends into the opening of the body, the detachment section being constructed and arranged to be cut by a consumer;

wherein to remove the tag from engagement with the product, at least a portion of the detachment section is severed from the body such that the first end of the channel becomes un-constrained in order that the opening may be expanded to remove the engagement portion from the product.

2. The anti-theft tag of claim 1, wherein the flexible portion is a plurality of flexible fingers supported by the body and extending into the opening.

3. The anti-theft tag of claim 2, wherein the plurality of flexible fingers are disposed about the perimeter of the opening.

4. The anti-theft tag of claim 3, wherein the plurality of flexible fingers are tapered and include a channel disposed between adjacent fingers.

5. The anti-theft tag of claim 1, wherein the detachment section includes a groove having a thickness less than a thickness of the body of the tag, the groove being constructed and arranged to receive a cutting tool therein.

6. The anti-theft tag of claim 5, wherein the detachment section is a tab supported by the body.

7. The anti-theft tag of claim 5, wherein the detachment section is formed within the product engagement portion.

8. The anti-theft tag of claim 1, wherein the opening has a circular shape.

9. The anti-theft tag of claim 1, wherein the base includes a cavity constructed and arranged to support the electronic article surveillance sensor.

10. The anti-theft tag of claim 9, wherein the base includes a cover constructed and arranged to fit over the cavity.

11. The anti-theft tag of claim 1, further including an electronic article surveillance sensor supported by the base.

12. The anti-theft tag of claim 1, wherein the base and the body are formed as a single, unitary member.

13. The anti-theft tag of claim 1, in combination with the product having one or more ridges on a portion thereof.

14. The anti-theft tag of claim 13, wherein the ridges are a threaded connection.

15. An anti-theft tag for use with a product having one or more ridges, the tag comprising:

a base constructed and arranged to support an electronic article surveillance sensor;

a body including a product engagement portion having an opening configured and sized to receive a portion of the product therein;

a locking member including a plurality of flexible fingers supported by the body and constructed and arranged to move over the one or more ridges in a first direction and to engage the one or more ridges in a second direction, opposite the first direction, to prevent movement of the tag in the second direction; and a detachment section including a channel having a first end constrained by the detachment section and a second end that extends into the opening of the body, and a groove having a thickness less than a thickness of the body of the tag, the groove being constructed and arranged to receive a cutting tool therein.

16. The anti-theft tag of claim 15, wherein the plurality of flexible fingers are disposed about the perimeter of the opening and extend from the body into the opening.

17. The anti-theft tag of claim 16, wherein the plurality of flexible fingers are tapered and include a channel disposed between adjacent fingers.

18. The anti-theft tag of claim 15, wherein the detachment section is a tab supported by the body.

19. The anti-theft tag of claim 15, wherein the detachment section is formed within the product engagement portion.

20. The anti-theft tag of claim 15, wherein the base includes a cavity constructed and arranged to support the electronic article surveillance sensor.

21. The anti-theft tag of claim 20, wherein the base includes a cover constructed and arranged to fit over the cavity.

22. The anti-theft tag of claim 15, further including an electronic article surveillance sensor supported by the base.

23. A method of using an anti-theft tag with a product having one or more ridges, comprising the steps of:

providing an anti-theft tag including:

a) a product engagement portion having an opening configured and sized to receive a portion of the product therein;

b) a locking member including a plurality of flexible fingers constructed and arranged to move over the one or more ridges in a first direction and to engage the one or more ridges in a second direction, opposite the first direction, to deter removal of the tag from the product; and c) a detachment section including a channel having a first end constrained by the detachment section and a second end that extends into the opening of the body; and inserting the ridged portion of the product into the opening of the product engagement portion and into engagement with the locking member.

24. The method of claim 23, further comprising the steps of:

cutting through the detachment section into the channel so as to free the first, constrained end of the channel;

expanding the circumference of the opening of the product engagement portion; and removing the locking member from engagement with the ridged portion.

* * * * *